US009279339B2

(12) United States Patent
Rodriguez

(10) Patent No.: US 9,279,339 B2
(45) Date of Patent: Mar. 8, 2016

(54) TURBINE ENGINE TEMPERATURE CONTROL SYSTEM WITH HEATING ELEMENT FOR A GAS TURBINE ENGINE

(71) Applicant: Jose L. Rodriguez, Lake Mary, FL (US)

(72) Inventor: Jose L. Rodriguez, Lake Mary, FL (US)

(73) Assignee: Siemens Aktiengesellschaft, München (DE)

( * ) Notice: Subject to any disclaimer, the term of this patent is extended or adjusted under 35 U.S.C. 154(b) by 479 days.

(21) Appl. No.: 13/798,213

(22) Filed: Mar. 13, 2013

(65) Prior Publication Data

US 2014/0271152 A1 Sep. 18, 2014

(51) Int. Cl.

| | |
|---|---|
| ***F04D 31/00*** | (2006.01) |
| ***F01D 25/08*** | (2006.01) |
| ***F01D 21/12*** | (2006.01) |
| ***F01D 25/26*** | (2006.01) |

(52) U.S. Cl.

CPC ..... *F01D 25/08* (2013.01); *F01D 21/12* (2013.01); *F01D 25/26* (2013.01); *F05D 2260/601* (2013.01)

(58) Field of Classification Search

CPC ..... F01D 25/08; F01D 25/10; F01D 25/12; F01D 25/14; F01D 25/26; F01D 21/12; F01D 11/24; F01D 19/02; F05D 2260/601

See application file for complete search history.

(56) References Cited

U.S. PATENT DOCUMENTS

| | | | | |
|---|---|---|---|---|
| 2,402,841 | A | 6/1946 | Ray | |
| 5,205,115 | A * | 4/1993 | Plemmons | F01D 11/24 415/115 |
| 5,352,087 | A | 10/1994 | Antonellis | |
| 5,980,201 | A | 11/1999 | Benoist et al. | |
| 6,523,346 | B1 | 2/2003 | Hoffmann et al. | |
| 6,599,083 | B2 | 7/2003 | Belzner et al. | |
| 6,640,550 | B2 | 11/2003 | Hoffmann et al. | |
| 6,644,012 | B2 | 11/2003 | Hoffmann et al. | |
| 6,668,553 | B1 | 12/2003 | Ghizawi | |
| 7,273,345 | B2 | 9/2007 | Birrell et al. | |
| 7,329,084 | B2 | 2/2008 | Dittmann et al. | |
| 7,766,610 | B2 | 8/2010 | Busekros et al. | |
| 7,861,536 | B2 | 1/2011 | Alecu et al. | |
| 7,980,054 | B2 | 7/2011 | Suciu et al. | |
| 7,987,660 | B2 | 8/2011 | Iwasaki et al. | |
| 8,157,503 | B2 | 4/2012 | Junod | |
| 2002/0085911 | A1 | 7/2002 | Marushima et al. | |

(Continued)

FOREIGN PATENT DOCUMENTS

| | | | |
|---|---|---|---|
| EP | 503752 | A1 | 6/1992 |

*Primary Examiner* — Thomas Denion
*Assistant Examiner* — Mickey France

(57) ABSTRACT

A turbine engine temperature control system configured to limit thermal gradients from being created within an outer casing surrounding a turbine airfoil assembly during shutdown of a gas turbine engine and for preheating an engine during a cold startup is disclosed. By reducing thermal gradients caused by hot air buoyancy within the mid-region cavities in the outer casing, arched and sway-back bending of the outer casing is prevented, thereby reducing the likelihood of blade tip rub, and potential blade damage, during a warm restart. The turbine engine temperature control system may also be used for cold startup conditions to heat engine components such that gaps between turbine airfoil tips and adjacent blade rings can be made larger from thermal expansion, thereby reducing the risk of damage. The turbine engine temperature control system may operate during turning gear system operation after shutdown of the gas turbine engine or during a cold startup.

19 Claims, 2 Drawing Sheets

(56) References Cited

U.S. PATENT DOCUMENTS

2007/0065274 A1 3/2007 Birrell et al.
2008/0131270 A1* 6/2008 Paprotna ..... F01D 11/20 415/173.2
2009/0208321 A1* 8/2009 O'Leary ..... F01D 11/24 415/14
2009/0317242 A1 12/2009 Down et al.
2012/0167584 A1* 7/2012 Philippot ..... F01D 11/24 60/778
2013/0156541 A1* 6/2013 Eleftheriou ..... F01D 11/20 415/1
2013/0251500 A1* 9/2013 Cheung ..... F01D 11/24 415/1

* cited by examiner

TURBINE ENGINE TEMPERATURE CONTROL SYSTEM WITH HEATING ELEMENT FOR A GAS TURBINE ENGINE

FIELD OF THE INVENTION

This invention is directed generally to turbine engines, and more particularly to systems enabling warm startups of the gas turbine engines without risk of turbine blade interference with radially outward sealing surfaces.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. Because of the mass of these large gas turbine engines, the engines take a long time to cool down after shutdown. Many of the components cool at different rates and as a result, interferences develop between various components. The clearance between turbine blade tips and blade rings positioned immediately radially outward of the turbine blades is such a configuration in which an interference often develops. More specifically, the turbine vane carriers with blade rings typically cool faster than the turbine rotor assembly including the turbine blades. As a result, the turbine vane carriers reduce in diameter more than the turbine rotor assembly. Thus, if it is desired to startup the gas turbine before is has completely cooled, there exists a significant risk of damage to the turbine blades due to turbine blade tip rub from the interference between the turbine blade tips and the blade rings caused by the blade rings and turbine vane carriers cooling and shrinking faster than the turbine rotor assembly. Thus, a need exists for reducing turbine vane carrier and blade ring cooling after shutdown.

SUMMARY OF THE INVENTION

A turbine engine temperature control system configured to limit thermal gradients from being created within an outer casing surrounding a turbine airfoil assembly during shutdown of a gas turbine engine and for preheating an engine during a cold startup is disclosed. By reducing thermal gradients caused by hot air buoyancy within the mid-region cavities in the outer casing, arched and sway-back bending of the outer casing may be prevented, thereby reducing the likelihood of blade tip rub, and potential blade damage, during a warm restart of the gas turbine engine. The turbine engine temperature control system may also be used for cold startup conditions to heat engine components such that gaps between turbine airfoil tips and adjacent blade rings can be made larger from thermal expansion, thereby reducing the risk of damage. The turbine engine temperature control system may operate during turning gear system operation after shutdown of the gas turbine engine to allow the outer casing to uniformly, from top to bottom, cool down or may operate during a cold startup to preheat turbine engine components.

The turbine engine temperature control system may include an outer casing surrounding an airfoil assembly of a gas turbine engine positioned concentrically within the outer casing such that a cavity exists between the outer casing and the airfoil assembly. The turbine engine temperature control system may also include a first air ejector positioned above a horizontally extending centerline of the outer casing to exhaust heated air into the cavity. The first air ejector may be formed from a first air ejector body with at least one exhaust orifice positioned in the first air ejector body. The turbine engine temperature control system may include at least one heating element extending into the cavity for heating air within the cavity.

The first air ejector body may have a cross-sectional shape when viewed axially that includes a radially outward base surface that is wider than a rounded head. The first air ejector body may have a curved upstream surface and a curved downstream surface coupled together with a rounded head. The curved upstream surface may include a first generally linear base section separated from a generally linear head section by a curved transition section, wherein the generally linear head section is adjacent to the rounded head. In at least one embodiment, the downstream surface may be longer than the upstream surface. The first air ejector body may have a cross-sectional shape when viewed axially that includes a radially outward base surface that is wider than a radially inwardmost point. A base surface of the first air ejector body may be curved about an axially extending longitudinal axis and when viewed in a direction aligned with the longitudinal axis. In at least one embodiment, the one or more exhaust orifices positioned in the first air ejector body may be formed from a plurality of exhaust orifices positioned closer to a rounded head of the first air ejector body than to a base surface of the first air ejector body.

The turbine engine temperature control system may include an exhaust opening of the at least one exhaust orifice first air ejector positioned in a downstream facing surface. The at least one heating element may be positioned radially inward from an outer surface of the first air ejector body. A fluid flow guide may extend laterally such that one or more heating elements is positioned between the fluid flow guide and the first air ejector body to guide the flow of fluid to the heating element. The fluid flow guide may have a width in a direction that is aligned with an axially extending axis that is greater than a width of a base surface of the first air ejector body in the direction. The heating element may be formed from at least one radially extending member extending radially inward from the first air ejector body. In another embodiment, the heating element may be formed from a plurality of radially extending members extending radially inward between the first air ejector body and a fluid flow guide extending laterally to guide the flow of fluid to the heating elements. The plurality of radially extending members may be laterally spaced apart enabling fluid to flow therebetween.

The turbine engine temperature control system may also include one or more supply manifolds contained within the first air ejector body and in fluid communication with the one or more exhaust orifices. The turbine engine temperature control system may include one or more fluid supply systems in fluid communication with the supply manifold to supply fluid to the supply manifold and to the exhaust orifices in the air ejector body.

In another embodiment, the turbine engine temperature control system may include a second air ejector extending into the cavity to exhaust fluid into the cavity. The second air ejector may have one or more exhaust orifices positioned in a second air ejector body of the second air ejector. The second air ejector may be positioned below the horizontally extending centerline of the outer casing. The second air ejector may be positioned on an opposite side of the outer casing from the first air ejector. In one embodiment, the first air ejector may be positioned at top dead center, and the second air ejector may be positioned at bottom dead center. The one or more exhaust orifices in the first air ejector body may be positioned to emit fluid in a first circumferential direction, and one or more exhaust orifices in the second air ejector body may be positioned to emit fluid in the same circumferential direction to create circumferential fluid flow within the cavity. The turbine engine temperature control system may also include a temperature control system configured to emit fluid from the exhaust orifice in the first air ejector body at a different temperature than the at least one exhaust orifice in the second air ejector body.

An advantage of the turbine engine temperature control system is that the system limits thermal gradients caused by hot air buoyancy within the outer casing, and prevents arched and sway-back bending of the outer casing, thereby reducing the likelihood of blade tip rub, and potential blade damage, during a warm restart of the gas turbine engine.

Another advantage of the turbine engine temperature control system is that the system helps to mitigate vertical gradients between the top and bottom of the outer casing.

Yet another advantage of the turbine engine temperature control system is that the system may be installed in currently existing gas turbine engines, thereby making gas turbine engines that are currently in use more efficient by enabling warm startups to occur rather than waiting days for the gas turbine engines to cool enough for a safe startup.

Another advantage of the turbine engine temperature control system is that the system may enable gas turbine engines to be assembled with tighter tolerances for improved performance.

Still another advantage of the turbine engine temperature control system is that due to a large amplification ratio, a very small amount of air is required to induce a large quantity of fluid flow within the cavity in the outer casing using small tubing with an inner diameter of about ⅜ of an inch compared with a conduit having a diameter of between three inches and eight inches for direct injection for a blower.

Another advantage of the turbine engine temperature control system is that the system ejects a very small amount of air, and thus, existing compressors that provide shop air could be used, thereby not requiring additional equipment or expense.

Yet another advantage of the turbine engine temperature control system is that the heating element need not be large in size and power consumption because the amount of air needed is small, and thus, the heating load is small.

Another advantage of the turbine engine temperature control system is that the temperature control system may supply air to the first and second air ejectors at different temperatures.

Still another advantage of the turbine engine temperature control system is that the air supplied to the first air ejector above the horizontally extending centerline of the outer casing may be colder than air supplied to the second air ejector below the horizontally extending centerline to enhance the overall temperature distribution in the cavity to optimize airfoil tip clearances.

Another advantage of the turbine engine control system is that the system may be used after shutdown to minimize the time needed before a restart can be performed without turbine airfoil clearance issues existing.

Yet another advantage of the turbine engine control system is that the system may be used in combination with different levels of turning gear operation to obtain and maintain an optimum startup tip clearance target in the shortest time after shutdown.

Another advantage of the turbine engine control system is that the system may be used typically only during turning gear operation, therefore there is no impact to normal operation.

Still another advantage of the turbine engine control system is that the system, other than the heater and compressor, does not include moving parts, and thus, the system should experience long life with little maintenance required.

Another advantage of the turbine engine control system is that the heating element can provide additional heating capacity in addition to heated air supplied by the temperature control system through the first or second air ejectors, or both.

Yet another advantage of the turbine engine control system is that the system may be implemented in numerous cavities, including, but not limited to, turbine vane carrier cavities, forward cavity in exhaust or aft cavity, where the system could be operated continuously without heated air or possibly without the heating element.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
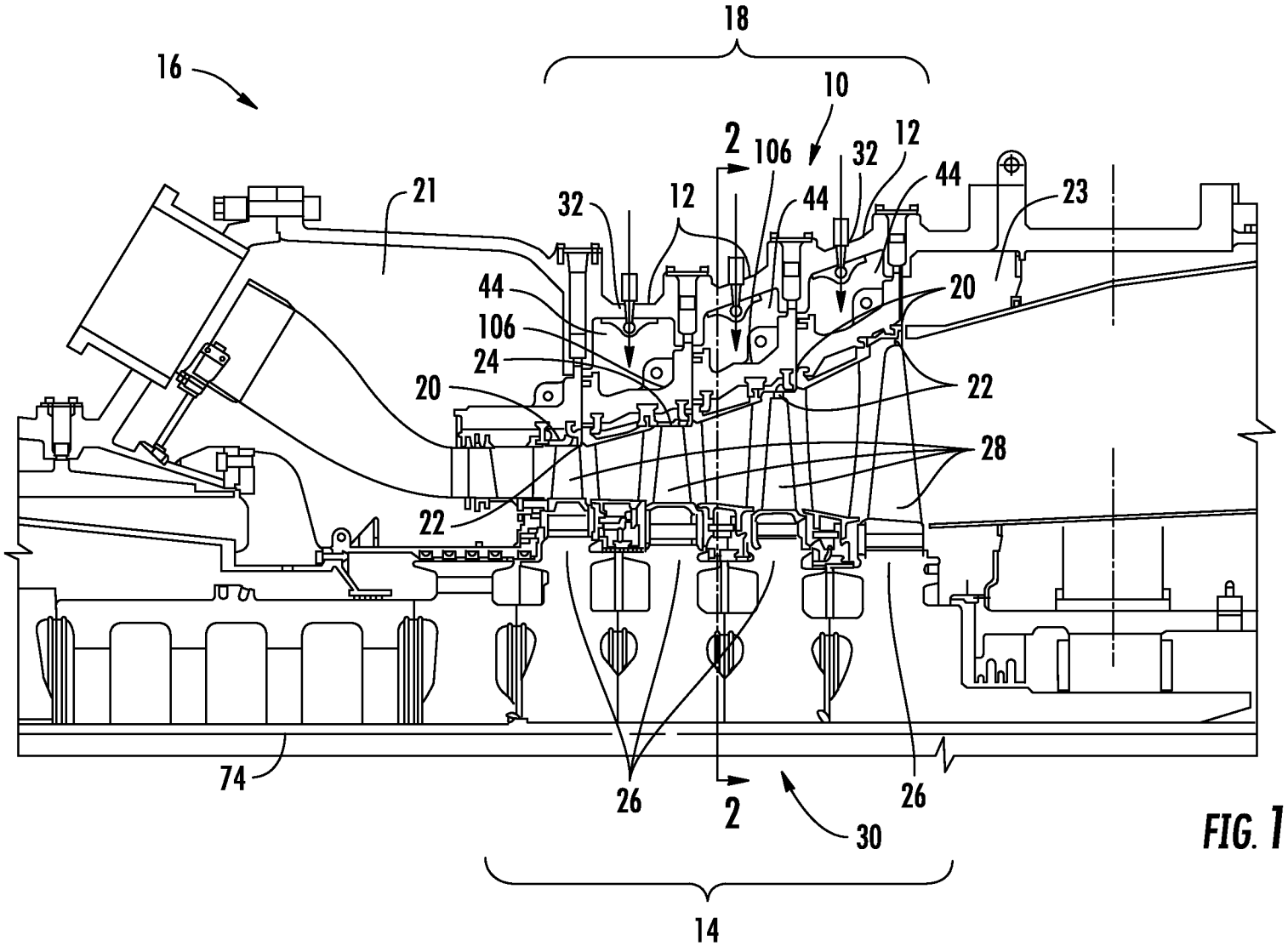
FIG. 1 is a cross-sectional side view of a gas turbine engine including the turbine engine temperature control system.

As shown in FIGS. 1-4, a turbine engine temperature control system 10 configured to limit thermal gradients from being created within an outer casing 12 surrounding a turbine airfoil assembly 14 during shutdown of a gas turbine engine 16 and for preheating an engine 16 during a cold startup is disclosed. The turbine engine temperature control system 10 may also be configured to limit thermal gradients in midframe cavities 21 and in exhaust cavities 23. By reducing thermal gradients caused by hot air buoyancy within the mid-region cavities 18 in the outer casing 12, arched and sway-back bending of the outer casing 12 may be prevented, thereby reducing the likelihood of blade tip rub, and potential blade damage, during a warm restart of the gas turbine engine 16. The turbine engine temperature control system 10 may also be used for cold startup conditions to heat engine components such that gaps 20 between turbine airfoil tips 22 and adjacent blade rings 24 can be made larger from thermal expansion, thereby reducing the risk of damage. The turbine engine temperature control system 10 may operate during turning gear system operation after shutdown of the gas turbine engine 16 to allow the outer casing 12 to uniformly, from top to bottom, cool down or may operate during a cold startup to preheat turbine engine components.

Figure 2:
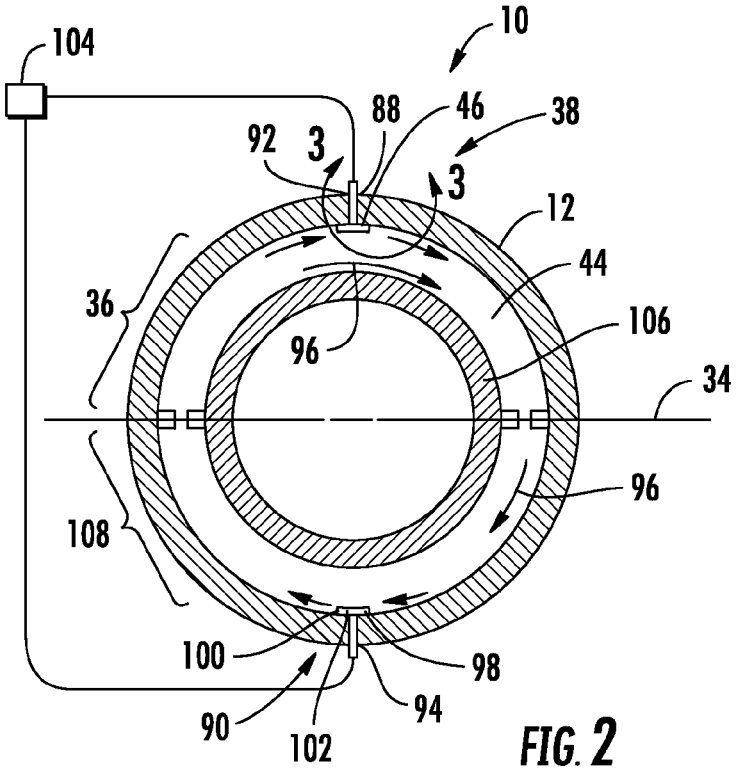
FIG. 2 is an axial view of an outer case with the turbine engine temperature control system taken at section line 2-2 in FIG. 1.

As shown in FIGS. 1 and 2, the turbine engine temperature control system 10 may include an outer casing 12 surrounding a turbine airfoil assembly 14 of the gas turbine engine 16 positioned concentrically within the outer casing 12 such that a cavity 44 exists between the outer casing 12 and the turbine airfoil assembly 14. The turbine airfoil assembly 14 may be a turbine blade assembly or a compressor blade assembly. The turbine airfoil assembly 14 may include a plurality of rows 26 of turbine airfoils 28 extending radially outward from a rotor 30. The outer casing 12 may form an internal cavity 44 between the outer casing 12 and vane carrier 106. The outer casing 12 surrounding the turbine airfoil assembly 14 may have a plurality of inspection orifices 32 in the outer casing 12 above a horizontal axis 34 defining an upper half 36 of the outer casing 12. The cavity 44 may extend circumferentially about the turbine airfoil assembly 14 and may be positioned within the outer casing 12. The outer casing 12 may be one or more cavities 44, as shown in FIGS. 1 and 2, or may include multiple partitions forming partitioned cavities within the outer casing 12.

The turbine engine temperature control system 10 may include a first air ejector 38 positioned above a horizontally extending centerline 34, as shown in FIG. 2, of the outer casing 12 to exhaust air into the cavity 44. The air exhausted into the cavity 44 from the first air ejector 38 may or may not be heated. The first air ejector 38 may be formed from a first air ejector body 46 with at least one exhaust orifice 48 positioned in the first air ejector body 46. The first air ejector 38 may include an exhaust opening 54 of the at least one exhaust orifice 48 positioned in a downstream facing surface 56. In at least one embodiment, the first air ejector 38 may include a plurality of exhaust orifices 48. In one embodiment, the plurality of exhaust orifices 48 may be positioned closer to a rounded head 60 of the first air ejector body 46 than to a base surface 58 of the first air ejector body 46. The exhaust orifices 48 forming the plurality of exhaust orifices 48 may be equally spaced from each other, randomly spaced from each other, or spaced in a repeated or nonrepeated pattern. The exhaust orifices 48 may have any appropriate size and configuration.

Figure 3:
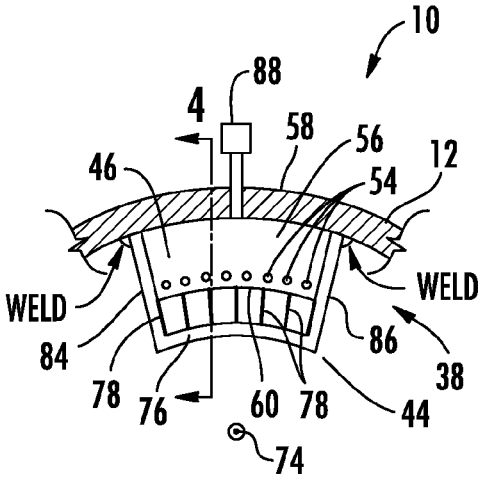
FIG. 3 is a detailed view of the turbine engine temperature control system in the outer case taken at detail line 3-3 in FIG. 2.
Figure 4:
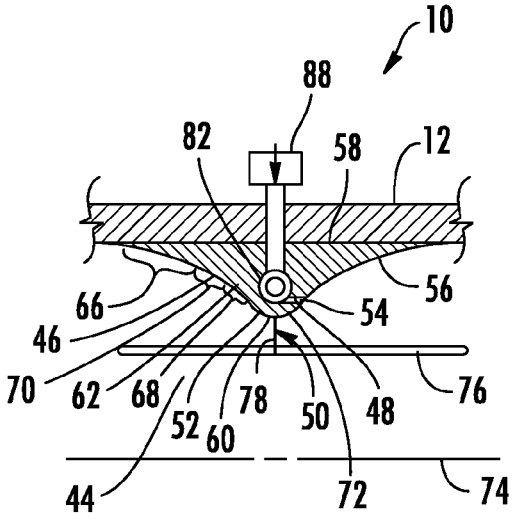
FIG. 4 is a cross-sectional side view of the turbine engine temperature control system taken at section line 4-4 in FIG. 3.

As shown in FIG. 4, the first air ejector body 46 may have a cross-sectional shape when viewed axially that includes a radially outward base surface 58 that is wider than a rounded head 60. The first air ejector body 46 may have a curved upstream surface 62 and a curved downstream surface 56 coupled together with a rounded head 60. The curved upstream surface 62 may include a first generally linear base section 66 separated from a generally linear head section 68 by a curved transition section 70. The linear head section 68 may be adjacent to the rounded head 60. In another embodiment, the curved upstream surface 62 may be formed from two cubic surfaces coupled together at an inflection point. In one embodiment, the downstream surface 56 may be longer than the upstream surface 62. In other embodiments, the downstream and upstream surfaces 62, 56 may have other geometric configurations. The first air ejector body 46 may have a cross-sectional shape when viewed axially that includes a radially outward base surface 58 that is wider than a radially inwardmost point 72. As shown in FIG. 3, the base surface 58 of the first air ejector body 46 may be curved circumferentially about an axially extending longitudinal axis 74 when viewed in a direction aligned with the longitudinal axis 74. The longitudinal axis 74 may be the longitudinal axis of an engine 16.

As shown in FIGS. 3 and 4, the turbine engine temperature control system 10 may include one or more heating elements 50 extending into the cavity 44 for heating air within the cavity 44. The heating element 50 may be positioned radially inward from an outer surface 52 of the first air ejector body 46. The heating element 50 may be formed from at least one radially extending member 78 extending radially inward from the first air ejector body 46. One or more fluid flow guides 76 may extend laterally such that the at least one heating element 50 is positioned between the fluid flow guide 76 and the first air ejector body 46 to guide the flow of fluid to the heating element 50. The fluid flow guide 76 may have a width in a direction that is aligned with an axially extending axis 74 that is greater than a width of the base surface 58 of the first air ejector body 46 in the direction. The plurality of radially extending members 78 may be laterally spaced apart enabling fluid to flow therebetween. In at least one embodiment, the heating element 50 may be formed from a plurality of radially extending members 78 extending radially inward between the first air ejector body 46 and a fluid flow guide 76 extending laterally to guide the flow of fluid to the heating element 50.

The turbine engine temperature control system 10 may include one or more supply manifolds 82 contained within the first air ejector body 46 and in fluid communication with the exhaust orifice 48. The supply manifold 82 may extend laterally within the first air ejector body 46. In at least one embodiment, the supply manifold 82 may extend laterally within the first air ejector body 46 from a first side edge 84 to a second side edge 86. The supply manifold 82 may be in fluid communication with each orifice 48 of the plurality of orifices 48. The turbine engine temperature control system 10 may also include one or more fluid supply systems 88 in fluid communication with the supply manifold 82. The fluid supply system 88 may supply the supply manifold 82 with fluid, such as, but not limited to air, such as compressed air, ambient air and the like.

In one embodiment, the turbine engine temperature control system 10 may include one or more second air ejectors 90 extending into the cavity 44 to exhaust fluid into the cavity 44. The second air ejector 90 may be formed from a second air ejector body 98 having one or more exhaust openings 100 on a downstream surface and in communication with one or more exhaust orifices 102. The second air ejector 90 may include one or more of the components of the first air ejector 38 described above and may be configured as the first air ejector 38 is described above as well. The recitation of each component and their configurations are not repeated here for brevity. The second air ejector 90 may be positioned below the horizontally extending centerline 34 of the outer casing 12 in the lower half 108 of the outer casing 12. The second air ejector 90 may be positioned on an opposite side of the outer casing 12 from the first air ejector 38. The first air ejector 38 may be positioned above the horizontally extending centerline 34, as shown in FIG. 2, and the second air ejector 90 may be positioned below the horizontally extending centerline 34. In at least one embodiment, the first air ejector 38 may be positioned at top dead center 92 of the outer casing 12, and the second air ejector 90 may be positioned at bottom dead center 94 of the outer casing 12.

The first air ejector 38 may be positioned to create a circumferential flow within the cavity 44. In particular, at least one of the exhaust openings 54 of the exhaust orifice 48 in the first air ejector body 46 may be positioned to emit fluid circumferentially such that the fluid entrains fluid within the cavity 44 to create a circumferential flow of fluid within the cavity 44. In another embodiment, one or more exhaust orifices 48 in the first air ejector body 46 may be positioned to emit fluid in a first circumferential direction 96, and one or more exhaust orifices 48 in the second air ejector body 98 is positioned to emit fluid in the same circumferential direction 96 to create circumferential fluid flow within the cavity 44.

The turbine engine temperature control system 10 may include one or more temperature control systems 104 configured to emit fluid from the exhaust orifice 48 in the first air ejector body 46 at a different temperature than the exhaust orifice 102 in the second air ejector body 98.

The turbine engine temperature control system 10 may be used for different facets of temperature control of components of a gas turbine engine 16 to reduce thermal gradients within the components, thereby limiting thermal stress within the gas turbine engine. In one embodiment, the turbine engine temperature control system 10 may be used to control temperatures of the upper half 36 of the outer casing 12 when the gas turbine engine is in shutdown mode to prevent the lower casing 108 from cooling faster than the upper casing 36 and forming thermal gradients and thermal stress between the two regions. The turbine engine temperature control system 10 may be used to circulate fluid, such as, but not limited to, air, within the cavity 44 to keep the temperature of fluid within the cavity 44 the same and generally, equally mixed therein. The temperature control system 104 may heat fluid before the fluid is emitted from the first air ejector 38. Once the fluid is ejected from the one or more exhaust orifices 48 in the first air ejector 38, the fluid may entrain fluid already existing in the cavity 44. The fluid may create a circumferential fluid flow within the cavity 44. The temperature control system 104 may The heating element 50 may also heat fluid flowing within the cavity 44 and past the heating element 50. In particular, the heating element 50 may heat fluid flowing past the one or more radially extending members 78. Thus, the fluid flows between the radially inwardmost point 72 and the fluid flow guide 76. While doing so, the fluid contacts the radially extending members 78 and a temperature higher than a temperature of the fluid, and thus the fluid is heated via convection heating.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine engine temperature control system, comprising:

an outer casing surrounding an airfoil assembly formed from gas turbine engine components positioned concentrically within the outer casing such that a cavity exists between the outer casing and the airfoil assembly;

a first fluid ejector positioned above a horizontally extending centerline of the outer casing to exhaust heated fluid into the cavity, wherein the first fluid ejector is formed from a first fluid ejector body with at least one exhaust orifice positioned in the first fluid ejector body;

a second fluid ejector extending into the cavity to exhaust fluid into the cavity, wherein the second fluid ejector has at least one exhaust orifice positioned in a second fluid ejector body;

wherein the at least one exhaust orifice in the first fluid ejector body is positioned to emit fluid in a first circumferential direction, and the at least one exhaust orifice in the second fluid ejector body is positioned to emit fluid in the same circumferential direction to create circumferential fluid flow within the cavity;

at least one heating element extending into the cavity for heating fluid within the cavity;

wherein the at least one heating element is positioned radially inward from an outer surface of the first fluid ejector body and wherein an exhaust opening of the at least one exhaust orifice of the first fluid ejector is positioned in a downstream facing surface; and a temperature control system configured to emit fluid from the at least one exhaust orifice in the first fluid ejector body at a different temperature than the at least one exhaust orifice in the second fluid ejector body.

2. The turbine engine temperature control system of claim 1, wherein the first fluid ejector body has a cross-sectional shape when viewed orthogonal to an axial view and nonradially that includes a radially outward base surface that is wider than a radially inwardmost point of the first fluid ejector body and wherein a base surface of the first fluid ejector body is curved about an axially extending longitudinal axis and when viewed axially in a direction aligned with the longitudinal axis.

3. The turbine engine temperature control system of claim 1, wherein the at least one exhaust orifice positioned in the first fluid ejector body is comprised of a plurality of exhaust orifices positioned closer to a rounded head of the first fluid ejector body than to a base surface of the first fluid ejector body.

4. The turbine engine temperature control system of claim 1, further comprising at least one supply manifold contained within the first fluid ejector body and in fluid communication with the at least one exhaust orifice and at least one fluid supply system in fluid communication with the at least one supply manifold.

5. The turbine engine temperature control system of claim 1, wherein the second fluid ejector is positioned below the horizontally extending centerline of the outer casing.

6. The turbine engine temperature control system of claim 1, wherein the first fluid ejector is positioned at top dead center of the cavity formed in part by the outer casing, and the second fluid ejector is positioned at bottom dead center of the cavity formed in part by the outer casing.

7. The turbine engine temperature control system of claim 1, further comprising a fluid flow guide extending laterally such that the at least one heating element is positioned between the fluid flow guide and the first fluid ejector body to guide the flow of fluid to the at least one heating element.

8. The turbine engine temperature control system of claim 7, wherein the fluid flow guide has a width in a direction aligned with an axially extending axis that is greater than a width of a base surface of the first fluid ejector body in the direction.

9. The turbine engine temperature control system of claim 1, wherein the first fluid ejector body has a cross-sectional shape when viewed orthogonal to an axial view and nonradially that includes a radially outward base surface that is wider than a rounded head and wherein the first fluid ejector body has a curved upstream surface and a curved downstream surface coupled together with a rounded head.

10. The turbine engine temperature control system of claim 9, wherein the curved upstream surface includes a first generally linear base section separated from a generally linear head section by a curved transition section, wherein the generally linear head section is adjacent to the rounded head.

11. The turbine engine temperature control system of claim 1, wherein the at least one heating element is formed from a plurality of radially extending members extending radially inward between the first fluid ejector body and a fluid flow guide extending laterally to guide the flow of fluid to the at least one heating elements and wherein the plurality of radially extending members are laterally spaced apart enabling fluid to flow therebetween.

12. A turbine engine temperature control system, comprising:

an outer casing surrounding an airfoil assembly formed from gas turbine engine components positioned concentrically within the outer casing such that a cavity exists between the outer casing and the airfoil assembly;

a first fluid ejector positioned above a horizontally extending centerline of the outer casing to exhaust heated fluid into the cavity, wherein the first fluid ejector is formed from a first fluid ejector body with at least one exhaust orifice positioned in the first fluid ejector body;

a second fluid ejector extending into the cavity to exhaust fluid into the cavity, wherein the second fluid ejector has at least one exhaust orifice positioned in a second fluid ejector body;

wherein the at least one exhaust orifice in the first fluid ejector body is positioned to emit fluid in a first circumferential direction, and the at least one exhaust orifice in the second fluid ejector body is positioned to emit fluid in the same circumferential direction to create circumferential fluid flow within the cavity;

wherein the first fluid ejector body has a cross-sectional shape when viewed orthogonal to an axial view and nonradially that includes a radially outward base surface that is wider than a rounded head and wherein the first fluid ejector body has a curved upstream surface and a curved downstream surface coupled together with a rounded head;

wherein the at least one exhaust orifice in the first fluid ejector body is positioned to emit fluid in a first circumferential direction, and the at least one exhaust orifice in the second fluid ejector body is positioned to emit fluid in the same circumferential direction to create circumferential fluid flow within the cavity;

at least one heating element extending into the cavity for heating fluid within the cavity;

wherein the at least one heating element is positioned radially inward from an outer surface of the first fluid ejector body and wherein an exhaust opening of the at least one exhaust orifice first fluid ejector is positioned in a downstream facing surface; and a temperature control system configured to emit fluid from the at least one exhaust orifice in the first fluid ejector body at a different temperature than a temperature of fluid within the cavity.

13. The turbine engine temperature control system of claim 12, wherein the fluid flow guide has a width in a direction aligned with an axially extending axis that is greater than a width of a base surface of the first fluid ejector body in the direction.

14. The turbine engine temperature control system of claim 12, wherein the curved upstream surface includes a first generally linear base section separated from a generally linear head section by a curved transition section, wherein the generally linear head section is adjacent to the rounded head.

15. The turbine engine temperature control system of claim 12, wherein a base surface of the first fluid ejector body is curved about an axially extending longitudinal axis and when viewed axially in a direction aligned with the longitudinal axis.

16. The turbine engine temperature control system of claim 12, wherein the at least one exhaust orifice positioned in the first fluid ejector body is comprised of a plurality of exhaust orifices positioned closer to a rounded head of the first fluid ejector body than to a base surface of the first fluid ejector body.

17. The turbine engine temperature control system of claim 12, further comprising at least one supply manifold contained within the first fluid ejector body and in fluid communication with the at least one exhaust orifice and at least one fluid supply system in fluid communication with the at least one supply manifold.

18. The turbine engine temperature control system of claim 12, wherein the second fluid ejector is positioned below the horizontally extending centerline of the outer casing.

19. The turbine engine temperature control system of claim 12, wherein the first fluid ejector is positioned at top dead center of the cavity formed in part by the outer casing, and the second fluid ejector is positioned at bottom dead center of the cavity formed in part by the outer casing.

* * * * *